US005267669A

United States Patent [19]

Dixon et al.

[11] Patent Number: 5,267,669

[45] Date of Patent: Dec. 7, 1993

[54] SELF SERVE BEVERAGE DISPENSER

[76] Inventors: Robert M. Dixon, 50 Talmadge Hill Rd., Darien, Conn. 06820; James E. Richardson, 28 Ladder Hill Rd., Weston, Conn. 06863

[21] Appl. No.: 756,923

[22] Filed: Sep. 9, 1991

[51] Int. Cl.[5] ..... B65D 23/00

[52] U.S. Cl. ..... 220/465; 220/466; 215/12.1

[58] Field of Search ..... 220/601, 465, 466, 408, 220/605, 628, 630, 4.04, 737, 740, 741, 465, 466; 215/12.1; 222/183, 185

[56] References Cited

U.S. PATENT DOCUMENTS

| | | | |
|---|---|---|---|
| 2,109,836 | 3/1938 | D'Ardenne | 220/466 X |
| 3,082,895 | 3/1963 | Leslie-Smith | 215/12.1 |
| 3,258,147 | 6/1966 | Rownd | 215/12.1 |
| 3,664,553 | 5/1972 | Rickmeier, Jr. | 215/12.1 X |
| 4,032,047 | 6/1977 | Wilson | 220/4.04 X |
| 4,482,067 | 11/1984 | Saito et al. | 220/605 X |
| 4,513,875 | 4/1985 | Kuehn, Sr. | 220/628 X |
| 4,793,491 | 12/1988 | Wolf et al. | 220/465 X |

OTHER PUBLICATIONS

Coleman Outdoor Products, Inc. 1991 Catalogue, p. 25.
Gott Corporation Catalogue, Form H811, pp. 4 and 10.

*Primary Examiner*—Steven M. Pollard
*Attorney, Agent, or Firm*—David P. Gordon

[57] ABSTRACT

A beverage dispenser is provided having a hollow shell member having an open end, a beverage receptacle enclosed within the shell member and engaged with the shell member and also having an open end, and a cover member which threadably engages the open end of the shell member and forms a liquid-tight seal with the open end of the beverage receptacle. A spigot for dispensing the beverage is provided and extends through the cover member, and a handle for manipulating the beverage dispenser is provided. For dispensing beer, the shell member is preferably shaped and colored as a beer keg, and the molded surface is formed to simulate a beer keg. Preferred aspects further include: making the beverage receptacle from a deformable plastic material with a beveled opening, and making the cover member with a tapered portion, such that when the cover member is threaded into the shell member the peripheral taper of the cover member forcibly contacts the deformable beveled opening of the beverage receptacle and provides a liquid tight seal between said cover member means and said beverage receptacle means; providing a window in the shell member to permit viewing of liquid level when the beverage dispenser is being filled; a hand grip in the bottom of the shell member to permit easy dunking of the beverage dispenser into water for cleaning; and an indentation on the shell member for receiving a logo of the beverage manufacturer.

20 Claims, 5 Drawing Sheets

SELF SERVE BEVERAGE DISPENSER

BACKGROUND

This invention broadly relates to beverage dispensers. More particularly, this invention relates to dispensers for beer, soft drinks and the like, which are readily cleansed, and which permit a consumer to dispense several glassfuls at will.

Various types of beverage dispensers, including cans, bottles, pitchers, kegs, and the like are known in the art. In dispensing draft beer, it is common either to fill a glass or mug directly from the tap, or to dispense the beer into a pitcher and then pour the beer from the pitcher into the mug. As many patron of bars and restaurants desire more than one glass of beer, the server of the beverage will typically be kept busy refilling mugs, and patrons often must wait until the server is available. The constant refilling of mugs can therefore be an inconvenience to both the server and the patron.

SUMMARY OF THE INVENTION

It is therefore an object of the invention to provide a beverage dispenser for beer, soft drinks, and the like, which holds several glassfuls of the beverage, and which is easily manipulated by a consumer.

It is another object of the invention to provide a beverage dispenser into which a beverage is easily poured, and from which the beverage is easily dispensed a bit at a time, and which is easily cleaned after the beverage has been dispensed.

It is a further object of the invention to provide a liquid-tight beverage dispenser which is made of materials suitable for contact with beverages, but which does not use compressible gaskets or the like and is therefore easily cleaned in commercial establishments.

Another object of the invention is to provide a beverage dispenser for beer which simulates a miniature beer keg, and which is easily manipulated and cleaned.

In accord with the objects of the invention, a beverage dispenser is provided and generally comprises a hollow shell member having an open end, a beverage receptacle enclosed within the shell member and engaged with the shell member and also having an open end, and a cover member which threadably engages the open end of the shell member and forms a liquid-tight seal with the open end of the beverage receptacle. A spigot for dispensing the beverage is provided and extends through the cover member, and a handle for manipulating the beverage dispenser is provided. Where the beverage dispenser is to be used for dispensing beer, the hollow shell member is preferably shaped and colored as a beer keg, and the molded surface is formed to simulate a beer keg.

In order to make a liquid-tight seal without using gaskets or other parts which are hard to clean, the inner surface of the shell member at the open end of the shell member is threaded, the beverage receptacle is made of deformable plastic material and is provided with a lip or ridge which sits in one support of the shell member and is further provided with a beveled opening which angles at a first angle, and the cover member is provided with threads and a peripheral tapered portion which tapers at a second angle. With the parts so arranged, when the cover member is threaded into the shell member, the peripheral taper of the cover member forcibly contacts the deformable beveled opening of the beverage receptacle and provides a liquid tight seal between said cover member means and said beverage receptacle means. Because some lateral movement is allowed between the beverage receptacle relative to the supporting shell member, as the cover member is screwed into the shell member, the beverage receptacle opening will self-center on the cover member to help create the liquid tight seal.

Other preferred aspects of the invention include: a window in the shell member which permits viewing of liquid level when the beverage dispenser is being filled; a hand grip in the surface of the beverage dispenser opposite the spigot which permits easy dunking of the beverage dispenser into water for cleaning after the cover member has been removed; grooves on the shell member surface for engaging a stand on which the beverage dispenser can sit; and an indentation on the shell member for receiving a logo of the beverage manufacturer.

Additional objects and advantages of the invention will become apparent to those skilled in the art upon reference to the detailed description taken in conjunction with the provided figures.

DETAILED DESCRIPTION OF THE PREFERRED EMBODIMENT

Figure 1A:
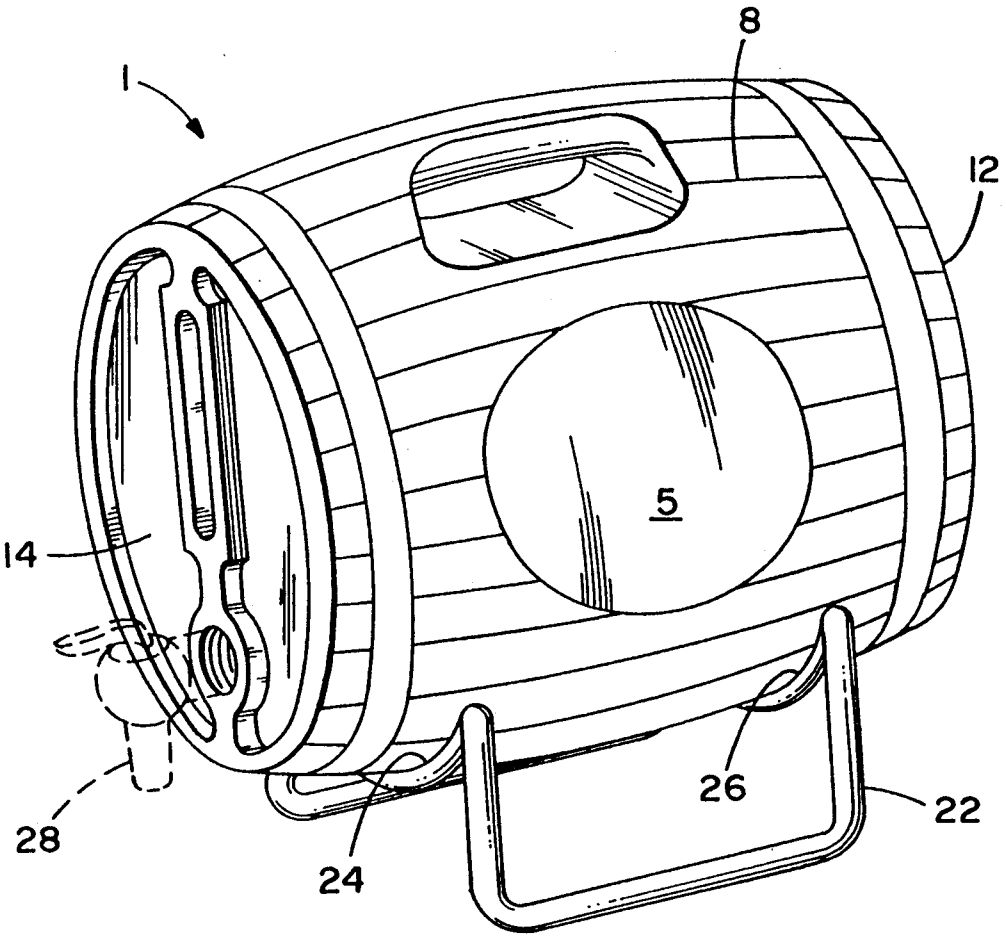
FIG. 1(A) is a perspective view of the dispenser of FIG. 1 in the "serve" position.

With reference to the drawings, FIGS. 1, 1(A), and 2, 2(A) and 2(B) show a beverage dispenser 1 in accordance with the present invention. The beverage dispenser 1 is comprised of a hollow shell 10, a threaded removable cover member 14 (which is shown with more particularity in FIGS. 3(A) and 3(B), and a beverage receptacle 16. The hollow shell 10 as shown in the preferred embodiment is barrel shaped. The barrel shaped shell is open on one end and terminates on the other end with a flat surface 212*a* on which the barrel can be stood. As seen best in FIG. 2, surface 212*a* and projection 212*b* together provide a slot in which a supporting base 12 which also acts as the bottom of the barrel is maintained. Supporting base, in turn, is formed with a slot 111 which serves as a finger slot for permitting the grasping of the beverage dispenser in a position opposite to that of FIG. 1 for cleaning. The finger slot 111 is made by indenting the the hollow shell during molding, with the indentation 11 acting as a supporting member for the beverage receptacle as will be discussed in more detail hereinafter. In addition to finger grip means 111, shell member 10 has a handle means 20 by which the beverage dispenser 1 can be grasped and picked up from its filling position of FIG. 1, and set down as shown in FIG. 1(A) on a wire frame support means 22. In order to help the stability of the beverage dispenser on the wire frame support means 22, the outer surface of shell member 10 is preferably provided with lateral transverse slots 24, 26 which engage the wire frame support and are transverse to longitudinal axis 32. Other preferred aspects of shell member 10 include a slightly indented lateral region 5 on the outer surface of shell member 10 which is shaped to receive for a label or logo representing the beverage to be put into the dispenser. If desired, the surface of shell member 10 can be striated and grooved to simulate a wooden barrel as indicated at 8.

Figure 1:
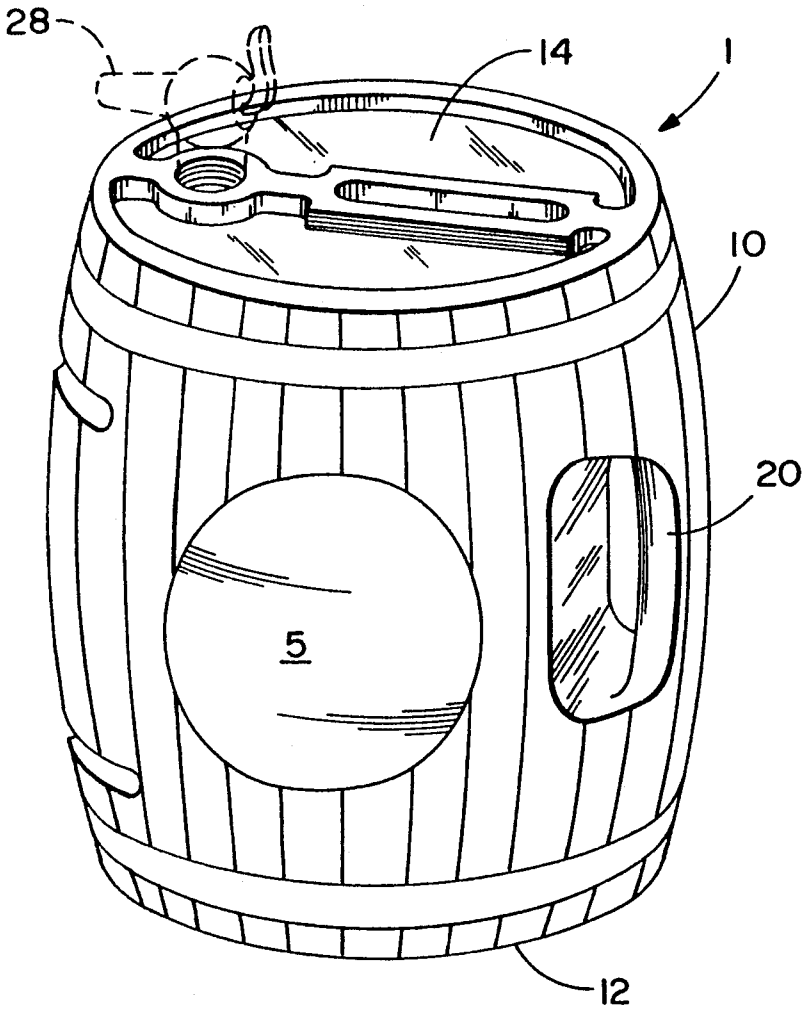
FIG. 1 is a perspective view of the dispenser of the present invention in the "filling" position.
Figure 2:
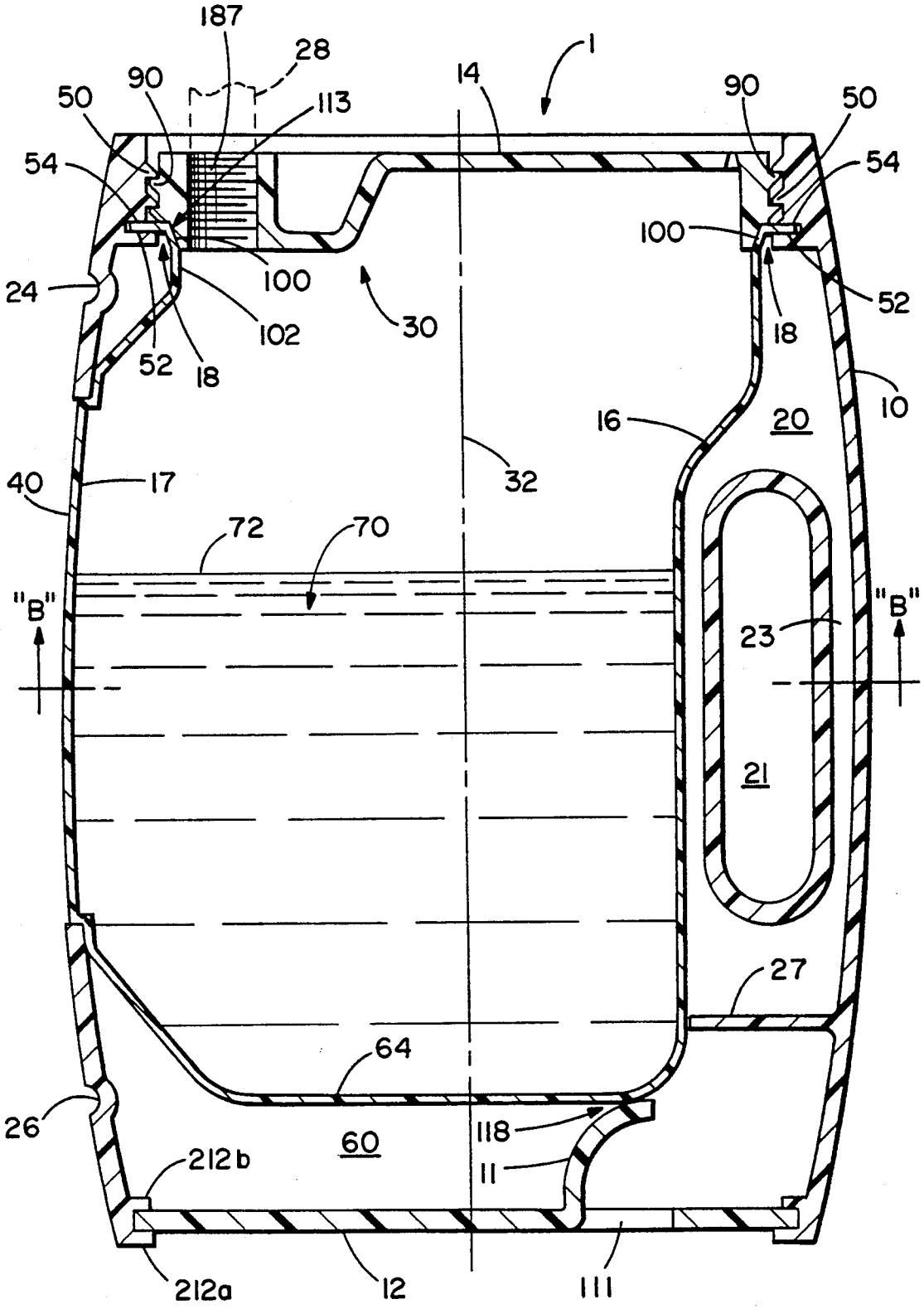
FIG. 2 is a sectional elevation view of the dispenser of the present invention shown in the "filling" position.
Figure 2A:
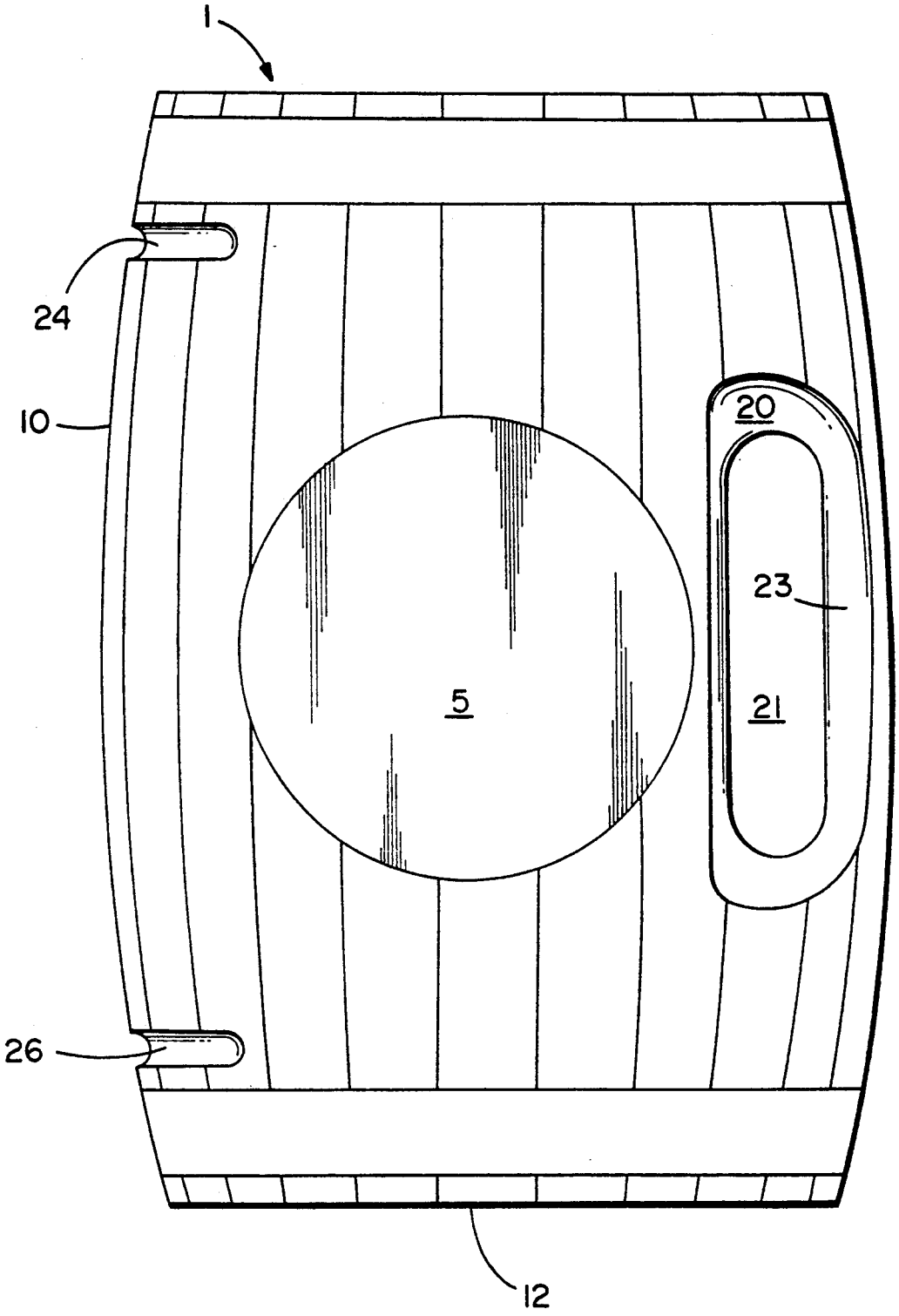
FIG. 2(A) is a side elevation view of the dispenser of FIG. 1.

With reference to the sectional elevational view of FIG. 2, shell member 10 which is suitably made of high impact styrene structural foam, has an opening 30 which is a top opening in the filling position of FIG. 1. Preferably, shell member 10 is made of two mating injection molded parts which can fit around the beverage receptacle 16, plus a third part 12 which serves as the bottom of the shell. In manufacture, the beverage receptacle 16 and the bottom 12 are held in position as the mating halves of the shell member barrel are mated and glued together. When so arranged, the hollow shell 10 encloses the beverage receptacle 16 and also supportively engages the beverage receptacle 16 as indicated at 18 and 118. The support at 118 comes from the upraised portion 11 of bottom 12 which is transverse to axis 32, while the support at 18 is provided by slot 54 which is also transverse to axis 32. A transversely extending support guide 27 is further provided as part of shell member 10 to aid in maintaining the alignment of receptacle 16 in shell member 10. It should be noted that the support at 118 is not necessary for this functioning of the beverage dispenser. In fact, it might be desirable to allow some axial movement of beverage receptacle 16 relative to shell member 10 for ensuring a liquid-tight seal as hereinafter described.

As aforementioned, shell member 10 has an integral handle grip means 20. The handle grip, as shown in FIGS. 1, 1(A), 2, 2(A), and 2(B) is shown as being offset from, and extending parallel to the longitudinal axis 32 of shell member 10. Handle grip opening 21 is recessed in the side of shell member 10 while the grip portion 23 is in-line with the envelope of the member 10 as shown in the drawings. A narrow lateral slot 40 in shell member 10 extends generally parallel to longitudinal axis 32 and diametrically opposite to grip means 20 over a good portion of the length of shell member 10 to expose a translucent longitudinal lateral portion 17 of beverage receptacle 16. Slot 40 permits viewing of the liquid level in the beverage dispenser upon filling; which viewing is particularly important when filling the dispenser 1 with beer, as care must be taken to provide enough liquid and not too much "head".

The open portion 30 of the shell member 10 has internal threads 50 which engage cover member 14 as hereinafter more fully described. In the position of FIG. 1(A), the beverage contents the dispenser 1 can be withdrawn through a conventional spigot 28 which is contained in the cover member as will be described in more detail hereinafter.

The beverage receptacle 16 is suitably made of blow molded high density polyethylene which is relatively thin walled and is resiliently deformable. Because it is resiliently deformable, in an alternative mode of manufacture, beverage receptacle 16 can be inserted through open portion 30 into shell member 10 until the bottom end 64 of beverage receptacle 16 rests on support 11 and the resilient peripheral lip 52 of receptacle 16 snaps into and engages slot 54 in shell member 10. However, in the preferred mode of manufacture, as aforementioned, the beverage receptacle is placed such that the two mating parts of shell member 10 mate around beverage receptacle 16 with lip 52 of beverage receptacle 16 engaging slot 54 of shell member 10. The engagement of lip 52 in slot 54 aids in the support and alignment of beverage receptacle 10 in shell member 10.

Because beverage receptacle 16 is preferably molded out of high density polyethylene of between 0.060 and 0.080 inches in thickness, it is translucent. Thus, any section 17 of the beverage receptacle 16 which is seen through the lateral slot 40 of the shell member will enable visual observation of the level 72 aforedescribed.

Figure 2B:
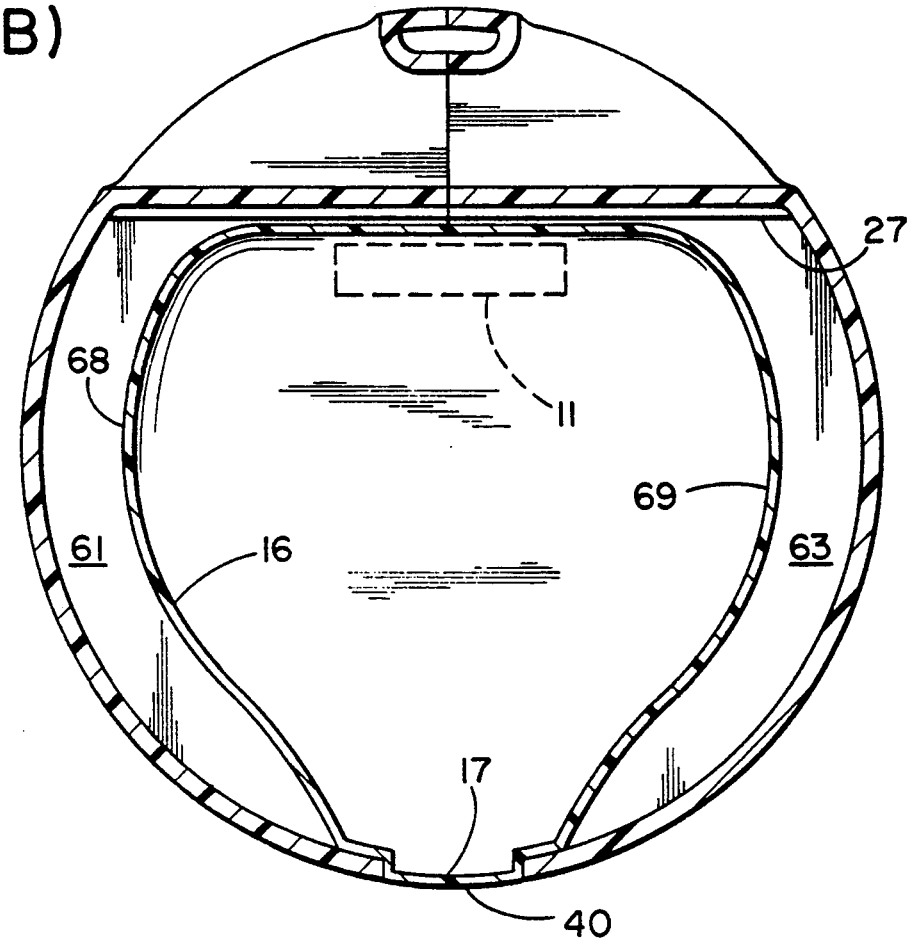
FIG. 2(B) is a cross section along axis B—B of FIG. 2.

Although not required, in the preferred embodiment a compartment 60 is formed between base 12 of shell member 10 and bottom 64 of receptacle 16, and lateral compartments 61, 63 are formed between the sides 68, 69 of receptacle 10 and the sides of shell member 10 (shown in the cross-section view of FIG. 2(B)). The compartments 60, 61, and 63 provide thermal insulation for the liquid contents 70 of receptacle 16.

Figure 3A:
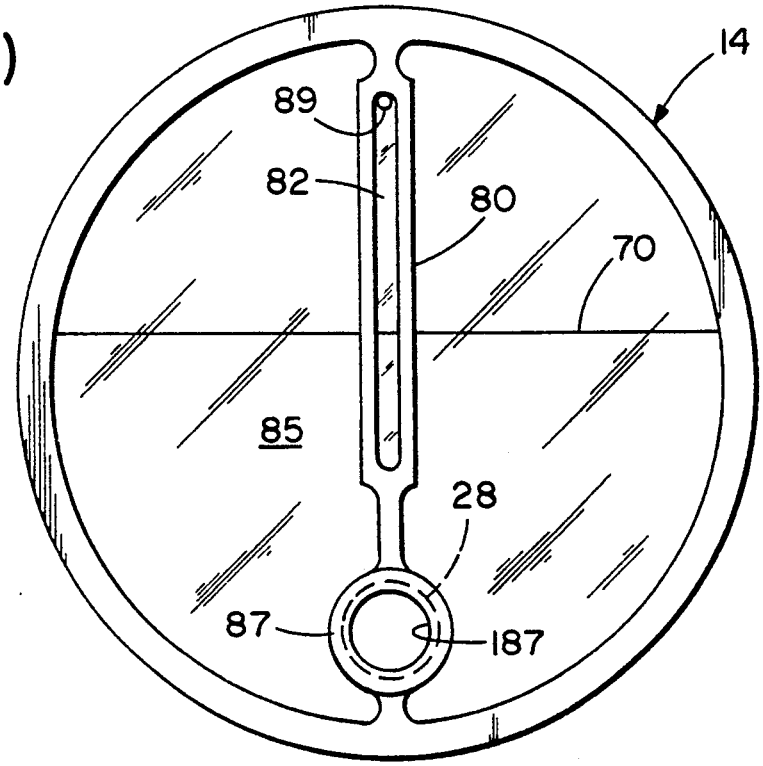
FIG. 3(A) is a top plan view of the cover member of the dispenser of FIG. 1.
Figure 3B:
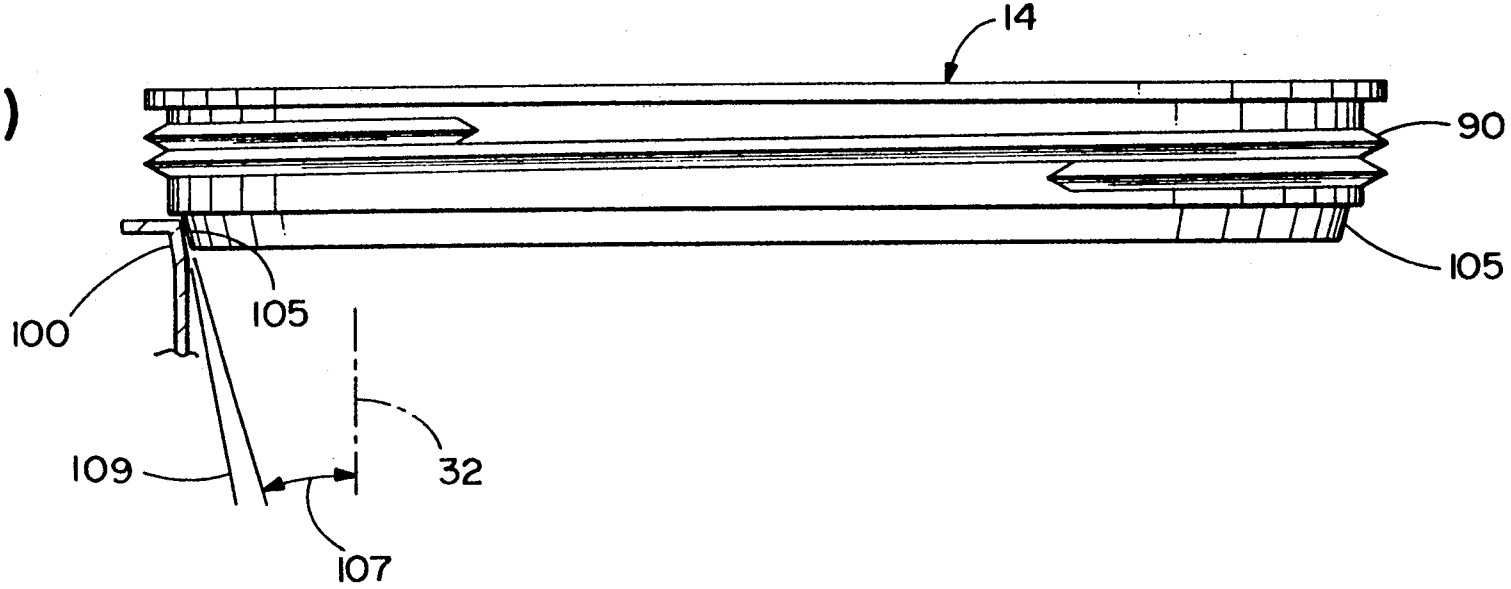
FIG. 3(B) is a side elevation view of the cover member of FIG. 3(A).
Figure 3C:
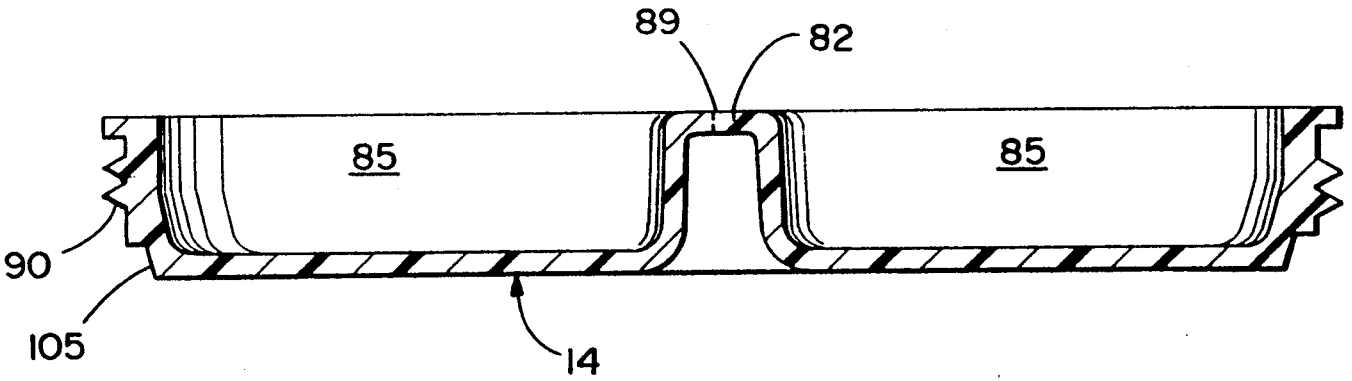
FIG. 3(C) is a sectional elevation view of the cover member of FIG. 3(A).

The cover member 14 of dispenser 1 shown particularly in FIGS. 3(A)-3(C) is suitably made of a substantially rigid clear plastic such as polycarbonate, K-resin, SAN, or blends thereof. Cover member 14 is preferably transparent so that the liquid level 70 when dispenser 1 is in the serve position position of FIG. 1(A) can be seen. Regardless, cover member 14 has a recessed transverse diametrical hollow turning rib 80 which has a vent hole 89 for pressure relief, and a translucent or transparent longitudinal strip 82. The vent hole 89 is preferably located at the end of rib 80 opposite the spigot 28 which is preferably in line with the turning rib 80. With the translucent longitudinal strip 82, even if cover member 14 itself is not translucent, the liquid level 70 can be seen through strip 82. Rib 80 partially bridges most of recess 84 and is adjacently in line with diametrical hollow outlet opening 187 which in conjunction with a gasket 87 or the like receives a conventional threaded tap spigot 28. In this manner, the beverage contained in the beverage dispenser 1 may be served through the spigot 28.

As best seen in FIGS. 3(B) and 3(C), cover member 14 has external peripheral threads 90, and a tapered portion 105 sitting behind the threads 90. The threads 90 are used to threadably engage the internal threads 50 of shell member 10. Upon turning the cover member 14 (via gripping rib 80 and rotating), the cover member 14 advances through opening 30 toward an inwardly sloped beveled peripheral circular ridge 100 of the circular inner rim 102 of beverage receptacle 16 (see FIG. 2 and FIG. 3(B)). As the cover member 14 advances, the tapered portion 105 of the covered member forcibly contacts the resiliently deformable tapered (beveled) portion 100 of the circular rim 102. Because the slope of the tapered portion 105 (as indicated at 107) of the cover member 14 is greater with respect to longitudinal axis 32 than the abutting slope of ridge 100 (as indicated at 109), advancement of the covered member wedges the cover member 14 in the resilient ridge 100 and results in a liquid tight circular peripheral seal for receptacle 10 as indicated in Fig. 2 at 113.

In the preferred embodiment, the cover member 14 is provided with a single complete outwardly extending thread, while the shell member 10 is provided with at least one inwardly extending thread. Also, in the preferred embodiment, the length and angle of tapered section 105 of the cover member 14, and the distance between the threads of the shell member 10 and the beveled portion 100 of the beverage receptacle 16, as well as the angle of the beveled portion 100 are particularly chosen such that the threading of the cover member 14 terminates with the spigot 28 located in the down position as shown in Fig. 1(A). More particularly, to ensure such an arrangement, before threading the cover onto the shell member for the first time, the beverage receptacle 16 is filled with very hot water (e.g., 120–140 degrees F.). Then, upon threading the cover member into the shell, the cover member is rotatably forced past its normal stopping point until the spigot 28 is in its proper position. This causes the beveled ridge 100 to form exactly as desired such that a liquid tight seal is obtained. It should be noted that with the beverage receptacle 16 being supported by the shell member at 18, some movement of the beverage receptacle 16 relative to the shell member 10 is permitted along longitudinal axis 32 as sealing is obtained. Also, as aforementioned, preferably some lateral movement is permitted to permit the beveled portion 100 of the beverage receptacle opening to center on the cover member 14 so as to enhance the forced fit and liquid seal.

While the preferred beverage dispenser 1 is provided with a beverage receptacle 16 which can hold ninety-two liquid ounces, and while the preferred range would typically be between sixty-four and one hundred twenty-eight ounces (i.e., between half a gallon and a gallon) it will be appreciated that other sized beverage receptacles can be utilized.

In use, the beverage dispenser 1 is placed on support surface 212*a*, or grasped by handle 23 and filled. As filling proceeds, if the liquid level in the beverage receptacle cannot be seen from the open end (e.g., due to foam), the liquid level is viewed via lateral slot 40 of the shell member through the translucent section 17 of the beverage receptacle 16. Upon completion of filling, the cover member 14 is placed int he opening of the shell member 10 and threaded into the shell member 10. Upon completion of threading (i.e., upon obtaining a liquid-tight seal), the beverage dispenser is preferably grasped by handle 23 and rotated by ninety degrees such that it may be placed on a stand 22 such as shown in FIG. 1(A). The beverage may then be dispensed from the beverage dispenser 1 by activating the spigot 28 as desired.

After the beverage has been dispensed and cleaning is desired, the beverage dispenser 1 is grasped by handle 23. Holding handle 23 in one hand, and grasping ridge 80 of the cover member 14 in the other hand, relative rotational movement is imparted to the cover member 14 to unthread the cover member 14 from the shell member 10. With the cover member removed, the cover member 14, and the shell member 10 containing the beverage receptacle 16, may be washed separately. Both parts may be washed in a dishwasher. Alternatively, both parts may be washed by hand. If it is desired to wash shell member 10 and beverage receptacle 16 by hand, the shell member 10 may be gripped at the finger grip opening 111 in the bottom surface 12, and the shell member and beverage receptacle 16 vertically dunked into a hot water tub. With the cover member 14 and the shell and beverage receptacle cleaned, the beverage dispenser may be refilled and the cover member 14 threaded again into the shell member so that the beverage dispenser can be reused.

There has been described and illustrated herein a beverage dispenser. While particular embodiments of the invention have been described, it is not intended that the invention be limited thereto, as it is intended that the invention be as broad in scope as the art will allow and that the specification be read likewise. Thus, while particular designs of the shell member, cover member, and beverage receptacle have been described and illustrated, other designs that meet the objects of this invention will occur to those skilled in the art. For example, while an integral handle with a recessed grip was provided on the shell member, it will be appreciated that other arrangements for a handle could be utilized (e.g., no recessed grip and an outwardly extending handle; or a finger grip arrangement such as is provided on the bottom). Similarly, while the shell was described as being manufactured in three injection molded parts out of high impact styrene which together simulate a barrel, it will be appreciated that different shapes, materials, number of pieces, and molding techniques can be used. Likewise, the materials and molding techniques for the beverage receptacle and cover member can also vary, provided that they meet FDA and/or similar requirements for coming into contact with beverages, and provided that the cover member can be threaded with the shell member. In that regard, it should be appreciated that the threads of the shell member can be located externally, and the threads of the cover member can be internal. Further, while a receptacle spigot was described, it will be appreciated that any dispensing means can be utilized. It will therefore be appreciated by those skilled in the art that yet other modifications could be made to the provided invention without deviating from its spirit and scope as so claimed.

We claim:

1. A beverage dispenser for dispensing a beverage, comprising:

a) a hollow shell member means having an internally threaded circular opening, and a support means;

b) a beverage receptacle means substantially enclosed within said shell member and engaged with said support means of said shell member, said beverage receptacle means having a circular beveled opening of deformable plastic material positioned below said internally threaded circular opening of said hollow shell member when sad shell member and beverage receptacle means are in a generally upright vertical position with their respective openings on top, said bevel being at a first angle relative to a longitudinal axis of said beverage dispenser, and said beverage receptacle means having a peripheral ridge for engaging said support means of said hollow shell member means;

c) a cover member means having an externally threaded circular peripheral portion for engaging the threaded circular opening of said shell member means and for advancement of the cover member means toward the deformable circular beveled opening of said beverage receptacle means, said cover member means having a circular peripheral tapered portion positioned rearward of its threaded circular peripheral portion, said tapered portion tapering at a second angle relative to said longitudinal axis, to forcibly contact the deformable circular beveled opening of said beverage receptacle to thereby provide a liquid tight seal between said cover member means and said beverage receptacle means;

d) spigot means coupled to said cover member means close to said peripheral portion and offset relative to said longitudinal axis, said spigot means for dispensing said beverage by gravity feed when said shell member and beverage receptacle means are in a generally horizontal position; and e) handle means engaging an outer surface of said hollow shell member for manipulating said beverage dispenser.

2. A beverage dispenser according to claim 1, wherein:

said support means comprises a groove in said hollow shell member means which engages and supports said peripheral ridge of said beverage receptacle means and permits some movement of said beverage receptacle means relative to said shell member means, wherein when said cover member means is advanced toward said beverage receptacle means, said circular beveled opening of said beverage receptacle means self-centers itself on said circular peripheral tapered portion of said cover member means.

3. A beverage dispenser according to claim 1, wherein:

said handle means is integral with said hollow shell member.

4. A beverage dispenser according to claim 3, wherein:

said handle means comprises a recessed handle grip extending parallel to said longitudinal axis of said beverage dispenser.

5. A beverage dispenser according to claim 1, wherein:

said receptacle means is translucent along at least a portion of its surface, and said shell member has a longitudinally extending slot which exposes said translucent portion of said receptacle means.

6. A beverage dispenser according to claim 1, wherein:

said hollow shell member means is constructed of high impact styrene structural foam, and said beverage receptacle means is constructed of high density polyethylene.

7. A beverage dispenser according to claim 1, wherein:

said cover member means further comprises a diametrically extending recessed hollow rib means for rotating said cover member.

8. A beverage dispenser according to claim 7, wherein:

said rib means has a pressure relief vent extending therethrough.

9. A beverage dispenser according to claim 8, wherein:

said cover member comprises an opening for receiving said spigot means and sealingly mating with said spigot means.

10. A beverage dispenser according to claim 9, wherein:

said opening for receiving said spigot means and said rib are diametrically in-line and said pressure relief vent is spaced opposite said spigot means.

11. A beverage dispenser according to claim 1, wherein:

an outer surface of said shell member is provided with a logo relating to the beverage to be dispensed in said beverage dispenser.

12. A beverage dispenser according to claim 1, wherein:

said shell member has a bottom member opposite said internally threaded opening, and said bottom member includes a finger gripping slot.

13. A beverage dispenser according to claim 1, in conjunction with a stand on which said beverage dispenser rests.

14. A beverage dispenser according to claim 1, wherein:

said shell member is substantially barrel-shaped and has an outer surface which is colored, striated and grooved to simulate a wooden barrel.

15. A beverage dispenser according to claim 1, wherein:

the length and angle of said circular peripheral tapered section of said cover member, and the longitudinal distance between the threads of said internally threaded opening of said shell member and said circular beveled opening of said beverage receptacle means, as well as the angle of the bevel of said beveled opening are chosen such that when said cover member is completely threaded in said shell member such that said cover member cannot be further threaded into said shell member due to contact between said circular peripheral tapered section of said cover member and said circular beveled opening of said beverage receptacle means, said cover member is in a position with an opening in said spigot facing down relative to said handle.

16. A beverage dispenser for dispensing a beverage, comprising:

a) a hollow shell member means having a threaded circular opening, a support means, and an outer surface, said outer surface provided with a logo relating to the beverage to be dispensed in said beverage dispenser, and said outer surface being substantially barrel-shaped, colored, striated and grooved to simulate a wooden barrel, and said outer surface having a longitudinally extending slot;

b) a beverage receptacle means enclosed within said shell member and engaged with said support means of said shell member, said beverage receptacle means having a circular opening of deformable plastic material, and said beverage receptacle means is translucent along at least a portion of its surface, and arranged such that said longitudinally extending slot of said shell means exposes said translucent portion of said receptacle means;

c) a cover member means having a threaded circular peripheral portion for engaging the threaded circular opening of said shell member means and for advancement of the cover member means toward the deformable circular beveled opening of said beverage receptacle means, said cover member means having a portion for forcibly contacting the deformable circular opening of said beverage receptacle to thereby provide a liquid tight seal between said cover member means and said beverage receptacle means;

d) spigot means coupled to said cover member means close to said peripheral portion and offset relative to said longitudinal axis, said spigot means for dispensing said beverage by gravity feed when said shell member and beverage receptacle means are in a generally horizontal position; and e) handle means engaging an outer surface of said hollow shell member for manipulating said beverage dispenser.

17. A beverage dispenser according to claim 16, wherein:

said hollow shell member means has a bottom member having a finger gripping slot.

18. A beverage dispenser according to claim 17, wherein:

said handle means is integral with said hollow shell member and comprises a recessed handle grip extending parallel to said longitudinal axis of said beverage dispenser.

19. A beverage dispenser according to claim 17, wherein:

said hollow shell member means is constructed by injection molding of high impact styrene structural foam, and said beverage receptacle means is constructed by blow molding high density polyethylene.

20. A beverage dispenser according to claim 17, wherein:

said cover member means further comprises a diametrically extending recessed hollow rib means for rotating said cover member, said rib means having a pressure relief vent extending therethrough, and said cover member has an opening for receiving said spigot and sealingly mating with said spigot, wherein said opening for receiving said spigot and said rib are diametrically in-line and said pressure relief vent is spaced opposite said spigot.

* * * * *